US011486287B2

(12) United States Patent
Sugimoto

(10) Patent No.: US 11,486,287 B2
(45) Date of Patent: Nov. 1, 2022

(54) CONTROL DEVICE OF INTERNAL COMBUSTION ENGINE

(71) Applicant: TOYOTA JIDOSHA KABUSHIKI KAISHA, Toyota (JP)

(72) Inventor: Hitoki Sugimoto, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 17/556,360

(22) Filed: Dec. 20, 2021

(65) Prior Publication Data

US 2022/0259999 A1 Aug. 18, 2022

(30) Foreign Application Priority Data

Feb. 12, 2021 (JP) ..... JP2021-021278

(51) Int. Cl.
*F01N 3/22* (2006.01)

(52) U.S. Cl.
CPC ..... *F01N 3/22* (2013.01); *F01N 2900/08* (2013.01)

(58) Field of Classification Search
CPC combination set(s) only.
See application file for complete search history.

(56) References Cited

U.S. PATENT DOCUMENTS 5,722,238 A * 3/1998 Tanahashi ..... F01N 11/002 60/276
2001/0054283 A1* 12/2001 Tayama ..... B01D 53/9431 60/285
2004/0177605 A1* 9/2004 Kojima ..... F01N 11/007 60/289
2006/0225410 A1* 10/2006 Uchida ..... F01N 11/005 60/299
2008/0092524 A1* 4/2008 Yokoyama ..... F01N 11/002 60/277
2009/0043437 A1* 2/2009 Shiino ..... F02D 17/00 903/902
2012/0324869 A1* 12/2012 Nakamura ..... F01N 11/007 60/276
2016/0237926 A1* 8/2016 Tanaka ..... F02D 41/0235

FOREIGN PATENT DOCUMENTS

JP 2013-148023 A 8/2013

* cited by examiner

*Primary Examiner* — Binh Q Tran
(74) *Attorney, Agent, or Firm* — Finnegan, Henderson, Farabow, Garrett & Dunner, LLP

(57) ABSTRACT

A control device is configured to execute a process of calculating an increase amount of deterioration obtained by subtracting from a first degree of deterioration that is a degree of deterioration of the three-way catalyst during execution of the oxygen supply process a second degree of deterioration that is a degree of deterioration of a three-way catalyst in a case where an oxygen supply process of supplying oxygen to an exhaust passage is assumed not to be executed, a process of calculating an integrated value of the increase amount of deterioration, and a process of executing a deterioration reduction process of reducing a rate of deterioration of the three-way catalyst in a case where the calculated integrated value is equal to or larger than a first determination value.

6 Claims, 3 Drawing Sheets

CONTROL DEVICE OF INTERNAL COMBUSTION ENGINE

CROSS-REFERENCE TO RELATED APPLICATION

This application claims priority to Japanese Patent Application No. 2021-021278 filed on Feb. 12, 2021, incorporated herein by reference in its entirety.

BACKGROUND

1. Technical Field

The present disclosure relates to a control device of an internal combustion engine.

2. Description of Related Art

For example, an internal combustion engine disclosed in Japanese Unexamined Patent Application Publication No. 2013-148023 (JP 2013-148023 A) executes a deterioration reduction process of suppressing progress of deterioration of a catalyst when a degree of deterioration of the catalyst provided in an exhaust passage is larger than a predetermined value.

SUMMARY

By the way, when an oxygen supply process of supplying oxygen to an exhaust passage is executed, a rate of deterioration of a catalyst is increased, so that there is a concern that time for a deterioration of the catalyst to reach a usage limit is shortened.

An aspect of the present disclosure relates to a control device applied to an internal combustion engine including a catalyst that cleans an exhaust gas in an exhaust passage and having a plurality of cylinders. The control device is configured to execute an oxygen supply process of supplying oxygen to the exhaust passage, a deterioration reduction process of reducing a rate of deterioration of the catalyst, a process of calculating an increase amount of deterioration obtained by subtracting from a first degree of deterioration that is a degree of deterioration of the catalyst during execution of the oxygen supply process a second degree of deterioration that is a degree of deterioration of the catalyst in a case where the oxygen supply process is assumed not to be executed, a process of calculating an integrated value of the increase amount of deterioration, and a process of executing the deterioration reduction process in a case where the integrated value is equal to or larger than a predetermined first determination value.

With the same configuration, the increase amount of deterioration is a value indicating the increase amount of the degree of deterioration of the catalyst due to an influence of the oxygen supply process. Then, when the integrated value of the increase amount of deterioration is equal to or larger than the first determination value, the deterioration reduction process is executed. Therefore, even when the deterioration of the catalyst progresses due to the execution of the oxygen supply process, the subsequent deterioration of the catalyst can be suppressed by the execution of the deterioration reduction process, so that the time for the deterioration of the catalyst to reach the usage limit can be lengthened.

A relationship between engine operation information when the oxygen supply process is executed and the first degree of deterioration may be predetermined, and the first degree of deterioration may be calculated based on the engine operation information acquired when the oxygen supply process is executed.

In addition, a relationship between engine operation information when the oxygen supply process is not executed and the second degree of deterioration may be predetermined, and the second degree of deterioration may be calculated based on engine operation information acquired when the oxygen supply process is executed.

The control device according to the aspect described above may be configured to execute a process of calculating a reduction amount of deterioration obtained by subtracting a third degree of deterioration that is a degree of deterioration of the catalyst during execution of the deterioration reduction process from a fourth degree of deterioration that is a degree of deterioration of the catalyst in a case where the deterioration reduction process is assumed not to be executed, a process of updating the integrated value by subtracting the reduction amount of deterioration from the integrated value, and a process of terminating the deterioration reduction process in a case where the integrated value updated in the process of updating is equal to or smaller than a predetermined second determination value that is set to a value smaller than the first determination value.

With the same configuration, the reduction amount of deterioration is a value indicating a reduction amount of the degree of deterioration of the catalyst corresponding to an effect of the deterioration reduction process. Then, when the integrated value updated by subtracting the reduction amount of deterioration from the integrated value is equal to or smaller than the second determination value, the deterioration reduction process is terminated. Therefore, it is possible to terminate the deterioration reduction process at appropriate timing.

A relationship between engine operation information when the deterioration reduction process is executed and the third degree of deterioration may be predetermined, and the third degree of deterioration may be calculated based on the engine operation information acquired when the deterioration reduction process is executed.

A relationship between engine operation information when the deterioration reduction process is not executed and the fourth degree of deterioration may be predetermined, and the fourth degree of deterioration is calculated based on engine operation information acquired when the deterioration reduction process may be executed.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

Configurations of Vehicle and Internal Combustion Engine

Hereinafter, an embodiment of a control device of an internal combustion engine will be described with reference to the drawings.

Figure 1:
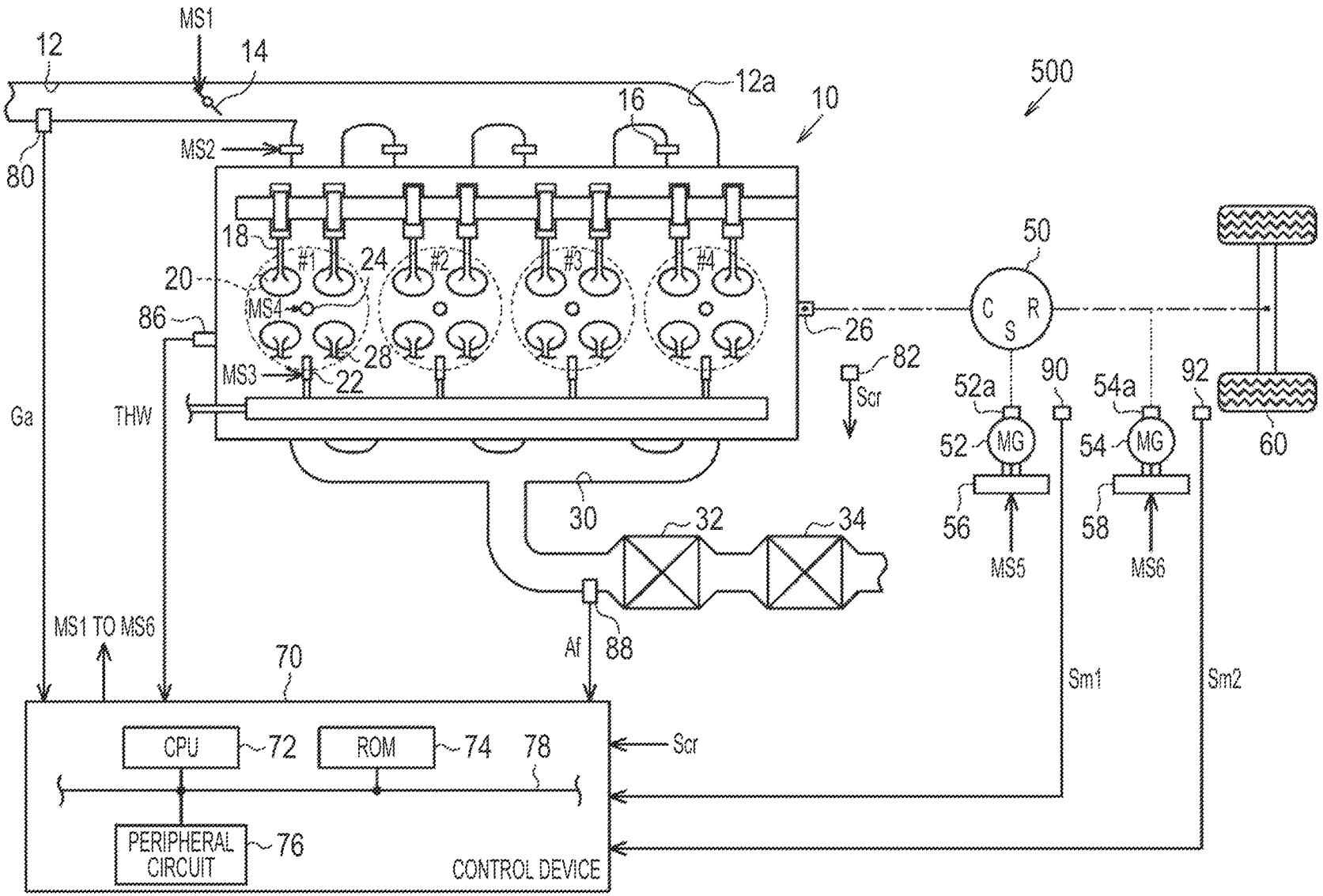
FIG. 1 is a diagram showing a configuration of an internal combustion engine, a drive system, and a control device according to an embodiment.

As shown in FIG. 1, an internal combustion engine 10 mounted on a vehicle 500 includes four cylinders #1 to #4. A throttle valve 14 is provided in an intake passage 12 of the internal combustion engine 10. An intake port 12*a* that is a downstream portion of the intake passage 12 is provided with a port injection valve 16 for injecting a fuel into the intake port 12*a*. Air sucked into the intake passage 12 or the fuel injected from the port injection valve 16 flows into a combustion chamber 20 when an intake valve 18 is opened. The fuel is injected into the combustion chamber 20 from an in-cylinder injection valve 22 for injecting the fuel into the cylinder. In addition, an air-fuel mixture of the air and the fuel in the combustion chamber 20 is used for combustion with a spark discharge of an ignition plug 24. Combustion energy generated at this time is converted into rotation energy of a crankshaft 26.

The air-fuel mixture used for the combustion in the combustion chamber 20 is discharged to an exhaust passage 30 as an exhaust gas when an exhaust valve 28 is opened. The exhaust passage 30 is provided with a three-way catalyst 32 having an oxygen storage capacity and a gasoline particulate filter (GPF 34) as an exhaust clean member that cleans the exhaust gas. Note that, in the present embodiment, it is assumed that the GPF 34 is a filter that collects a particulate matter (PM) and is supported by a three-way catalyst having the oxygen storage capacity.

The crankshaft 26 is mechanically connected to a carrier C of a planetary gear mechanism 50 that configures a power splitting device. A rotation shaft 52*a* of a first motor generator 52 is mechanically connected to a sun gear S of the planetary gear mechanism 50. In addition, a rotation shaft 54*a* of a second motor generator 54 and drive wheels 60 are mechanically connected to a ring gear R of the planetary gear mechanism 50. An alternating current voltage is applied to a terminal of the first motor generator 52 by an inverter 56. In addition, the alternating current voltage is applied to a terminal of the second motor generator 54 by an inverter 58.

A control device 70 controls the internal combustion engine 10 as a target, and operates operation units of the internal combustion engine 10, such as the throttle valve 14, the port injection valve 16, the in-cylinder injection valve 22, and the ignition plug 24 to control a torque, an exhaust gas component ratio, or the like as an amount of control of the internal combustion engine 10. In addition, the control device 70 controls the first motor generator 52 as a target, and operates the inverter 56 to control a rotation speed as an amount of control of the first motor generator 52. In addition, the control device 70 controls the second motor generator 54 as a target, and operates the inverter 58 to control a torque as an amount of control of the second motor generator 54. FIG. 1 shows operation signals MS1 to MS6 of the throttle valve 14, the port injection valve 16, the in-cylinder injection valve 22, the ignition plug 24, and the inverters 56, 58, respectively. The control device 70 refers to an intake air amount Ga detected by an air flow meter 80, an output signal Scr of a crank angle sensor 82, a coolant temperature THW detected by a coolant temperature sensor 86, and an air-fuel ratio Af detected by an air-fuel ratio sensor 88 provided on the upstream of the three-way catalyst 32 to control the amount of control of the internal combustion engine 10. In addition, the control device 70 refers to an output signal Sm1 of a first rotation angle sensor 90 that detects a rotation angle of the first motor generator 52 and an output signal Sm2 of a second rotation angle sensor 92 that detects a rotation angle of the second motor generator 54 to control the amount of control of the first motor generator 52 or the second motor generator 54. Note that the control device 70 calculates an engine rotation speed NE based on the output signal Scr. In addition, the control device 70 calculates an engine load factor KL based on the engine rotation speed NE and the intake air amount Ga. The engine load factor KL is a parameter that determines an amount of air filled in the combustion chamber 20, and is a ratio of an amount of inflow air per combustion cycle of one cylinder to a reference amount of inflow air. Note that the reference amount of inflow air is variably set in response to the engine rotation speed NE.

The control device 70 includes a CPU 72, a ROM 74, and a peripheral circuit 76, and the CPU 72, the ROM 74, and the peripheral circuit 76 can communicate with each other by a communication line 78. Here, the peripheral circuit 76 includes a circuit that generates a clock signal for predetermining an internal operation, a power supply circuit, a reset circuit, or the like. The control device 70 controls the amount of control by executing a program stored in the ROM 74 by the CPU 72.

Reproduction Process

The CPU 72 of the control device 70 calculates an accumulated amount DPM of the PM collected in the GPF 34 based on the engine rotation speed NE, the engine load factor KL, the coolant temperature THW, and the like.

Then, when the accumulated amount DPM is equal to or larger than a predetermined reproduction start threshold value, the control device 70 executes a specific cylinder fuel cut process (hereinafter, referred to as a specific cylinder FC process) as a reproduction process of reproducing the GPF 34.

The specific cylinder FC process includes a stop process of stopping the combustion of the air-fuel mixture in some cylinders of a plurality of the cylinders. In addition, the specific cylinder FC process includes an increase process of increasing an amount of fuel supplied to the combustion chamber 20 as compared to when the stop process is not executed such that the air-fuel ratio of the air-fuel mixture is richer than a stoichiometric air-fuel ratio in a case of the combustion of the air-fuel mixture in the remaining cylinder other than some cylinders.

The stop process is a process of stopping the combustion of the air-fuel mixture in the cylinder #1 by stopping the fuel injection from the port injection valve 16 and the in-cylinder injection valve 22 of the cylinder #1, for example. Note that, in the following, the cylinder in which the stop process is executed is referred to as an FC cylinder, and the remaining cylinder other than the FC cylinder, that is, the cylinder in which the combustion of the air-fuel mixture is executed is referred to as a combustion cylinder.

The increase process is a process of increasing the amount of fuel supplied to the combustion chamber 20 of each of the cylinder #2, the cylinder #3, and the cylinder as compared to when the stop process is not executed to supply an unburned fuel to the exhaust passage 30. In a case of the execution of the increase process, a value obtained by multiplying an increase amount coefficient K by a base injection amount Qb that is an injection amount for making the air-fuel ratio of the air-fuel mixture to the stoichiometric air-fuel ratio is set as a fuel injection amount Q of each of the cylinder #2, the cylinder #3, and the cylinder #4. The CPU 72 sets the increase amount coefficient K such that the unburned fuel in the exhaust gas discharged from the cylinder #2, the cylinder #3 and the cylinder #4 to the exhaust passage 30 is equal to or smaller than an amount that reacts with the oxygen discharged from the cylinder #1 without excess or deficiency. Specifically, at an initial stage of the reproduction process of the GPF 34, the CPU 72 sets the air-fuel ratio of the air-fuel mixture in the cylinder #2, the cylinder #3, and the cylinder #4 to a value being as close as possible to the amount that reacts with the oxygen without excess or deficiency to raise the temperature of the three-way catalyst 32 at an early stage.

When such a specific cylinder FC process is executed, the oxygen and the unburned fuel are discharged to the exhaust passage 30, so that the unburned fuel is oxidized in the three-way catalyst 32 and the temperature of the three-way catalyst 32 rises. When the temperature of the three-way catalyst 32 becomes high, the temperature of the GPF 34 rises due to the high-temperature exhaust gas flowing into the GPF 34. Then, the PM collected in the GPF 34 is oxidized and removed due to the oxygen flowing into the high-temperature GPF 34. The specific cylinder FC process is an oxygen supply process of supplying the oxygen to the exhaust passage.

Process Regarding Deterioration of Three-Way Catalyst

When the specific cylinder FC process is executed, the atmosphere of the three-way catalyst 32 is a high oxygen concentration, so that a rate of deterioration of the three-way catalyst 32 is increased as compared to when the specific cylinder FC process is not executed. In addition, when the specific cylinder FC process is executed, the temperature of the three-way catalyst 32 becomes high, so that the rate of deterioration of the three-way catalyst 32 is also increased. Therefore, the control device 70 calculates an integrated value S by integrating a degree of deterioration of the three-way catalyst 32. Then, when the integrated value S is equal to or larger than a predetermined first determination value Sref1, a deterioration reduction process of reducing the rate of deterioration of the three-way catalyst 32 is executed. Note that as such a deterioration reduction process, it is desirable to execute a process of reducing the oxygen concentration of the exhaust gas flowing into the three-way catalyst 32 or a process of lowering the temperature of the three-way catalyst 32. Therefore, in the present embodiment, a process of lowering the temperature of the three-way catalyst 32 by correcting the amount of fuel injected from the fuel injection valve of the internal combustion engine to be increased to make the air-fuel ratio of the air-fuel mixture richer than the stoichiometric air-fuel ratio is executed as the deterioration reduction process. Note that, in the present embodiment, a process of suppressing an excessive temperature rise of the three-way catalyst 32 by making the air-fuel mixture rich when the temperature of the three-way catalyst 32 is equal to or larger than a predetermined temperature threshold value THref, a so called OT increase process is used as the deterioration reduction process.

Hereinafter, the process regarding the deterioration of the three-way catalyst 32 will be described.

Figure 2:
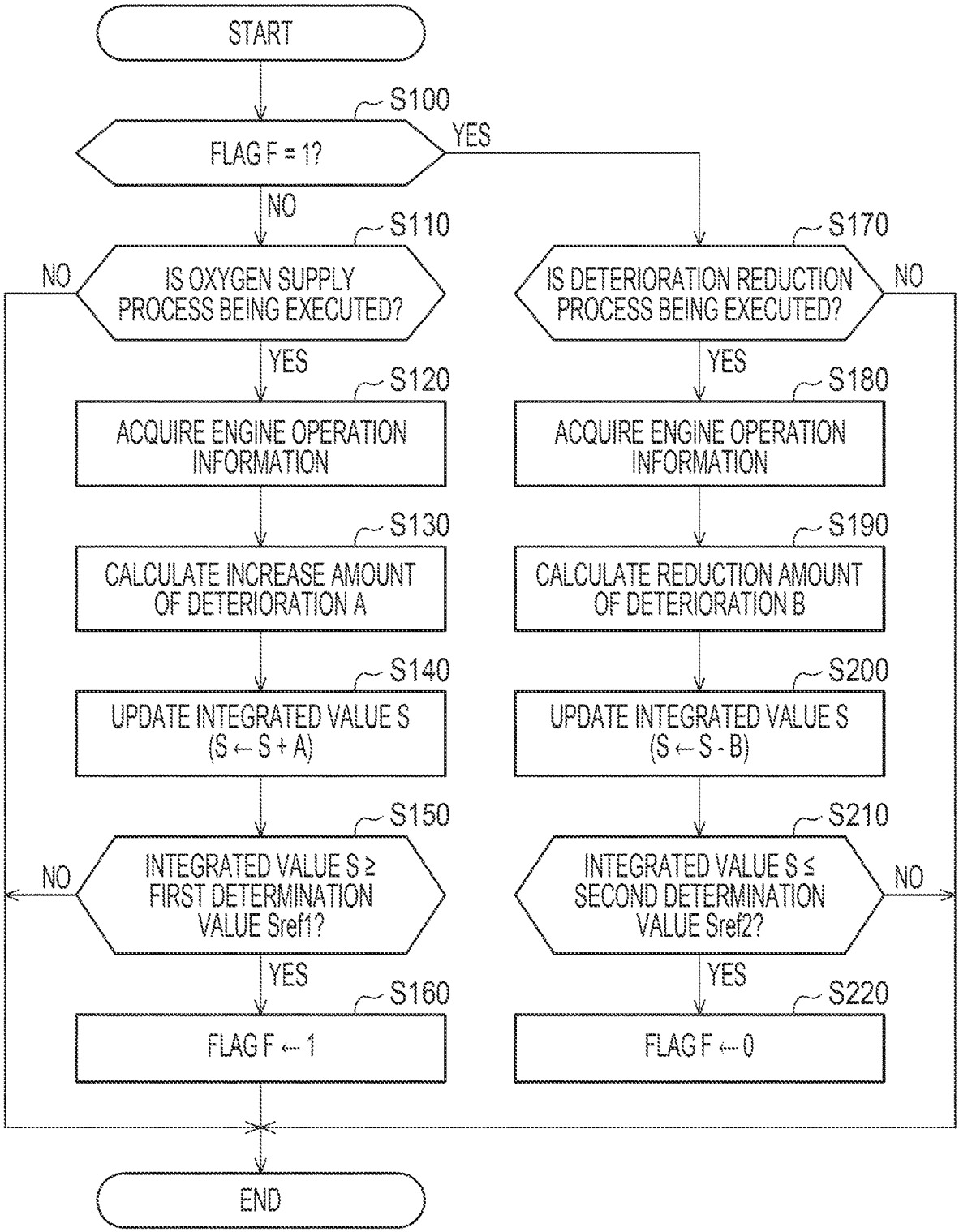
FIG. 2 is a flowchart showing a procedure regarding a process executed by the control device according to the embodiment.

FIG. 2 shows a procedure of the process executed by the control device 70 according to the present embodiment. The process shown in FIG. 2 is realized by the CPU 72 repeatedly executing the program stored in the ROM 74 at a predetermined cycle, for example. Note that, in the following, a step number of each process is represented by a number prefixed with "S".

In a series of processes shown in FIG. 2, a determination is made as to whether or not a value of a flag F is "1" (S100). The value of the flag F is operated in S160 or S220 described below, and an initial value of the flag F is "0".

In a case where the determination is made that the flag F is not "1" (S100: NO), the CPU 72 determines whether or not the specific cylinder FC process that is the oxygen supply process is currently being executed (S110). Then, in a case where the determination is made that the oxygen supply process is being executed (S110: YES), the CPU 72 acquires engine operation information (S120). The engine operation information acquired in S120 is, for example, the intake air amount Ga, the engine rotation speed NE, and the engine load factor KL.

Next, the CPU 72 calculates an increase amount of deterioration A by using the acquired engine operation information (S130).

When the degree of deterioration per unit time of the three-way catalyst 32 that is increased during the execution of the specific cylinder FC process is defined as a first degree of deterioration A1 and the degree of deterioration per unit time of the three-way catalyst 32 in a case where the specific cylinder FC process is not executed is defined as a second degree of deterioration A2, the increase amount of deterioration A is a value obtained by subtracting the second degree of deterioration A2 from the first degree of deterioration A1. That is, the increase amount of deterioration A indicates the increase amount of the degree of deterioration of the three-way catalyst 32 due to an influence of the specific cylinder FC process as a value per unit time.

The first degree of deterioration A1 is quantified from the following expression (1) based on an FC catalyst temperature Tfc that is the temperature of the three-way catalyst 32 during the execution of the specific cylinder FC process, an oxygen concentration OC that is the concentration of the oxygen supplied from the FC cylinder to the three-way catalyst 32, time t of an execution cycle of the process shown in FIG. 2, and each of adapted fixed values K, α, m.

$$A1=f[\exp(-K/Tfc)\cdot OC\hat{}\alpha\cdot t\hat{}m] \quad (1)$$

In addition, the second degree of deterioration A2 quantified from the following expression (2) based on a non-FC catalyst temperature Tfcn that is the temperature of the three-way catalyst 32 when the specific cylinder FC process is assumed not to be executed, time t of the execution cycle of the process shown in FIG. 2, and each of the adapted fixed values K, α, m.

$$A2=f[\exp(-K/Tfcn)\cdot t\hat{}m] \quad (2)$$

Note that the FC catalyst temperature Tfc is calculated by the CPU 72 based on a map in which a relationship between the engine operation information, such as the engine rotation speed NE or the engine load factor KL acquired in S120, and the temperature of the three-way catalyst 32 during the execution of the specific cylinder FC process is predetermined, a function expression, and the like.

The non-FC catalyst temperature Tfcn is calculated by the CPU 72 based on a map in which a relationship between the engine operation information, such as the engine rotation speed NE or the engine load factor KL acquired in S120, and the temperature of the three-way catalyst 32 during the non-execution of the specific cylinder FC process is predetermined, a function expression, and the like.

In addition, during the specific cylinder FC process, the oxygen concentration supplied from the FC cylinder to the three-way catalyst 32 is almost the same as the oxygen concentration in the air, and thus the oxygen concentration in the air is set in the oxygen concentration OC. Incidentally, in a case where the specific cylinder FC process is not executed, stoichiometric combustion is basically executed, and thus the oxygen is not contained in the exhaust gas in the exhaust passage 30. Therefore, in the expression (2), the term of "OC^α" in the expression (1) is "1".

The value obtained by subtracting the second degree of deterioration A2 from the first degree of deterioration A1 quantified as described above is calculated as the increase amount of deterioration A.

Next, the CPU 72 updates the integrated value S by adding the increase amount of deterioration A calculated in S130 to the integrated value S (S140). The integrated value S calculated in S140 is the integrated value of the increase amount of deterioration A, and indicates the degree of deterioration of the three-way catalyst 32 increased by the influence of the specific cylinder FC process. Note that an initial value of the integrated value S is set to "0", and the value of the integrated value S is stored in a backup RAM or the like, so that the value of the integrated value S is held even after the engine operation is stopped.

Next, the CPU 72 determines whether or not the integrated value S updated in S140 is equal to or larger than the first determination value Sref1 (S150). A magnitude of the first determination value Sref1 is set based on the integrated value S is equal to or larger than the first determination value Sref1 such that a determination can be accurately made that the integrated value S is increased to some extent that the execution of the deterioration reduction process is needed to be prompted.

Then, in a case where the determination is made that the integrated value S is equal to or larger than the first determination value Sref1 (S150: YES), the CPU 72 sets the value of the flag F to "1" (S160). When the flag F is set to "1", the temperature threshold value THref of the three-way catalyst 32 that executes the OT increase process is set to a value lower by the predetermined value α. As a result, the OT increase process is more likely to be executed as compared to a case where the flag F is set to "0".

In a case where the determination is made in S100 that the flag F is "1" (S100: YES), the CPU 72 determines whether or not the deterioration reduction process is currently being executed, that is, whether or not the OT increase process is being executed (S170). Then, in a case where the determination is made that the deterioration reduction process is being executed (S170: YES), the CPU 72 acquires the engine operation information (S180). The engine operation information acquired in S180 is, for example, the engine rotation speed NE, and the engine load factor KL.

Next, the CPU 72 calculates a reduction amount of deterioration B by using the acquired engine operation information (S190).

When the degree of deterioration per unit time of the three-way catalyst 32 that is increased during the execution of the deterioration reduction process is defined as a third degree of deterioration B3 and the degree of deterioration per unit time of the three-way catalyst 32 in a case where the deterioration reduction process is not executed is defined as a fourth degree of deterioration B4, the reduction amount of deterioration B is a value obtained by subtracting the third degree of deterioration B3 from the fourth degree of deterioration B4. That is, the reduction amount of deterioration B indicates the reduction amount of the degree of deterioration corresponding to the effect of the deterioration reduction process as a value per unit time.

The third degree of deterioration B3 is quantified from the following expression (3) based on a deterioration reduction catalyst temperature Tdr that is the temperature of the three-way catalyst 32 during the execution of the deterioration reduction process, time t of the execution cycle of the process shown in FIG. 2, and each of the adapted fixed values K, α, m.

$$B3=f[\exp(-K/Tdr)\cdot t\hat{}m] \quad (3)$$

In addition, the fourth degree of deterioration B4 is quantified from the following expression (4) based on a non-deterioration reduction catalyst temperature Tdrn that is the temperature of the three-way catalyst 32 when the deterioration reduction process is assumed not to be executed, time t of the execution cycle of the process shown in FIG. 2, and each of the adapted fixed values B, α, m.

$$B4=f[\exp(-K/Tdm)\cdot t\hat{}m] \quad (4)$$

Note that the deterioration reduction catalyst temperature Tdr is calculated by the CPU 72 based on a map in which a relationship between the temperature of the three-way catalyst 32 during the execution of the deterioration reduction process and the engine operation information, such as the engine rotation speed NE or the engine load factor KL, acquired in S180, is predetermined, a function expression, and the like.

In addition, the non-deterioration reduction catalyst temperature Tdrn is calculated by the CPU 72 based on a map in which a relationship between the temperature of the three-way catalyst 32 during the non-execution of the deterioration reduction process and the engine operation information, such as the engine rotation speed NE or the engine load factor KL, acquired in S180, is predetermined, a function expression, and the like. Incidentally, when the deterioration reduction process is executed or not executed, lean combustion in which the air-fuel ratio of the air-fuel mixture is leaner than the stoichiometric air-fuel ratio is not executed, so that the exhaust gas in the exhaust passage 30 does not contain the oxygen. Therefore, in the expression (3) or the expression (4), the term of "OC^α" in the expression (1) is "1".

The value obtained by subtracting the third degree of deterioration B3 from the fourth degree of deterioration B4 quantified as described above is calculated as the reduction amount of deterioration B.

Next, the CPU 72 updates the integrated value S by subtracting the reduction amount of deterioration B calculated in S190 from the integrated value S (S200).

Next, the CPU 72 determines whether or not the integrated value S updated in S200 is equal to or smaller than a predetermined second determination value Sref2 (S210). The second determination value Sref2 is a value smaller than the first determination value Sref1. A magnitude of the second determination value Sref2 is set based on the integrated value S is equal to or smaller than the second determination value Sref2 such that a determination can be accurately made that the integrated value S is reduced to some extent that the deterioration reduction process may be terminated. Incidentally, in the present embodiment, the second determination value Sref2 is set to "0".

Then, in a case where the determination is made that the integrated value S is equal to or smaller than the second determination value Sref2 (S210: YES), the CPU 72 sets the value of the flag F to "0" (S220). When this flag F is set to "0", the temperature threshold value THref that is set to a value lower by the predetermined value α is returned to the original value. As a result, the OT increase process executed as the deterioration reduction process is terminated.

Note that the CPU 72 temporarily terminates the series of processes shown in FIG. 2 in a case where the processes of S160 and S220 is completed or in a case where a negative determination is made in the processes of S110, S150, S170, and S210.

Action of Present Embodiment

Figure 3:
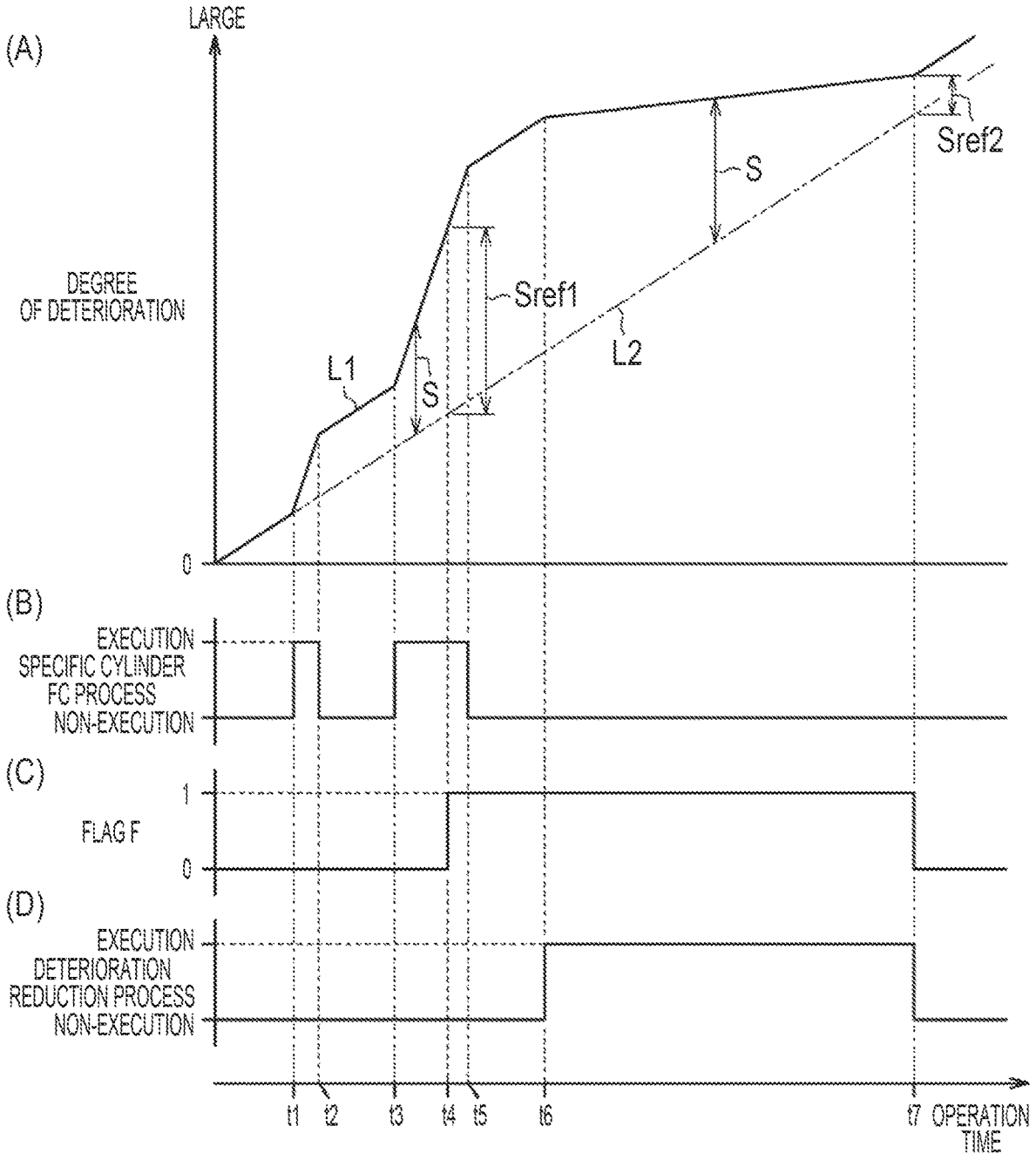
FIG. 3 is a timing chart showing an action of the embodiment.

An action of the present embodiment will be described with reference to FIG. 3. Note that a solid line L1 shown in FIG. 3 indicates an actual progress degree of deterioration of the actual three-way catalyst 32, and a two-dot chain line L2 indicates a progress degree of deterioration of the three-way catalyst 32 in a case where the oxygen supply process and the deterioration reduction process are not executed at all.

When the specific cylinder FC process that is the oxygen supply process is executed at time t1, the integrated value S is increased. Then, when the specific cylinder FC process is stopped at time t2, the increase in the integrated value S is also stopped.

Thereafter, when the specific cylinder FC process is executed again at time t3, the integrated value S is also increased again. Then, when the integrated value S is equal to or larger than the first determination value Sref1 at time t4, the flag F is set to "1". Thereafter, when the specific cylinder FC process is stopped at time t5, the increase in the integrated value S is stopped.

When the deterioration reduction process is executed by satisfying an execution condition at time t6, the integrated value S is reduced. Then, when the integrated value S is equal to or smaller than the second determination value Sref2 at time t7, the flag F is set to "0" and the deterioration reduction process is stopped.

Effect of Present Embodiment

An effect of the present embodiment will be described.

(1) As described above, the increase amount of deterioration A is the value indicating the increase amount of the degree of deterioration of the three-way catalyst 32 due to the influence of the oxygen supply process. Then, when the integrated value S of the increase amount of deterioration A is equal to or larger than the first determination value Sref1, the deterioration reduction process is executed. Therefore, even when the deterioration of the three-way catalyst 32 progresses due to the execution of the oxygen supply process, the subsequent deterioration of the three-way catalyst 32 can be suppressed by the execution of the deterioration reduction process, so that the time for the deterioration of the three-way catalyst 32 to reach an allowable limit can be lengthened.

(2) As described above, the reduction amount of deterioration B is the value indicating the reduction amount of the degree of deterioration of the catalyst, the reduction amount of the degree of deterioration corresponding to the effect of the deterioration reduction process. Then, when the integrated value S updated by subtracting the reduction amount of deterioration B from the integrated value S is equal to or smaller than the second determination value Sref2, the deterioration reduction process is terminated. Therefore, it is possible to terminate the deterioration reduction process at appropriate timing.

Modification Example

Note that the embodiment described above can be modified and carried out as follows. The embodiment described above and the following modification examples can be carried out in combination with each other within a technically consistent range.

The increase amount of the first degree of deterioration A1 or the increase amount of the second degree of deterioration A2 have a positive correlation with the execution time of the oxygen supply process. Therefore, by simply obtaining the increase amount of the first degree of deterioration A1 or the increase amount of the second degree of deterioration A2 by multiplying the execution time of the oxygen supply process by an appropriate adaptation coefficient and calculating a difference between the increase amounts thereof, a value SA corresponding to the integrated value of the increase amount of deterioration A is calculated. Then, in a case where the value SA is equal to or larger than the first determination value Sref1, the flag F may be set to "1".

In addition, the increase amount of the third degree of deterioration B3 or the increase amount of the fourth degree of deterioration B4 have a positive correlation with the execution time of the deterioration reduction process. Therefore, by simply obtaining the increase amount of the third degree of deterioration B3 or the increase amount of the fourth degree of deterioration B4 by multiplying the execution time of the deterioration reduction process by an appropriate adaptation coefficient and calculating a difference between the increase amounts thereof, a value SB corresponding to the integrated value of the reduction amount of deterioration B is calculated. Then, in a case where a value obtained by subtracting the value SB from the value SA is equal to or smaller than the second determination value Sref2, the flag F may be set to "0".

The second determination value Sref2 is set to "0", but another value may be used. For example, a value smaller than the first determination value Sref1 and larger than "0" may be used. In addition, the second determination value Sref2 may be set to a negative value. In this case, the flag F is set to "1" in a case where a cumulative value of the reduction amount of deterioration B exceeds a cumulative value of the increase amount of deterioration A.

In a case where the flag F is "1", the temperature threshold value THref is changed. In addition, in a case where the flag F is "1", the amount of fuel increased by the OT increase process may be further increased to further lower the temperature of the three-way catalyst 32.

In a case where the flag F is "1", the temperature threshold value THref for the execution of the deterioration reduction process is changed such that the deterioration reduction process can be easily executed. In addition, in a case where the flag F is "1", the deterioration reduction process may be forcibly executed.

As the deterioration reduction process, the OT increase process is used, but another process may be used.

For example, in general, a deceleration fuel cut-off is executed to cut the fuel in all of the cylinders at the time of deceleration. Here, when such a fuel cut is executed when the temperature of the three-way catalyst 32 is equal to or higher than a predetermined temperature threshold value THref2, the oxygen is supplied to the three-way catalyst 32 in a high-temperature state, so that the three-way catalyst 32 deteriorates due to heat. Therefore, when the temperature of the three-way catalyst 32 is equal to or higher than the temperature threshold value THref2 at the time of deceleration, a deceleration firing process of executing the stoichiometric combustion in each cylinder to the extent that the fuel cut is prohibited and misfire is not caused is executed. During the execution of the deceleration firing process, the oxygen concentration of the exhaust gas flowing into the three-way catalyst 32 is reduced as compared to a case where the fuel cut is executed, and thus the deceleration firing process can be used as the deterioration reduction process. Therefore, in a case where the flag F is "1", the temperature threshold value THref2 may be set to a value lower by a predetermined value β. In this case, as compared to a case where the flag F is set to "0", the deceleration firing process is more likely to be executed, so that the deterioration reduction process is more likely to be executed.

In addition, when an amount of EGR contained in the air-fuel mixture (amount of internal EGR or amount of external EGR) is increased, a combustion temperature of the air-fuel mixture is lowered, so that the temperature of the three-way catalyst 32 is lowered. Therefore, as the deterioration reduction process, an increase process for such an amount of EGR may be executed. In this case, in a case where the flag F is "1", the engine operation need only be controlled in a well-known manner such that the amount of EGR is increased as compared to a case of "0". Note that, as the deterioration reduction process, the process according to each of the modification examples described above may be used in combination as appropriate.

The process of executing the specific cylinder FC process is not limited to the reproduction process described above. For example, the specific cylinder FC process may be executed for catalyst warm-up or sulfur poisoning recovery.

The process of executing the specific cylinder FC process is not limited to the reproduction process described above. For example, in a case where an oxygen storage amount of the three-way catalyst 32 is equal to or smaller than a predetermined value, a process of stopping a combustion control solely in some cylinders executing a control of making the air-fuel ratio of the air-fuel mixture in the remaining cylinder to be the stoichiometric air-fuel ratio may be executed.

The number of cylinders in which the combustion is stopped when the specific cylinder FC process described above is executed is "1", but the number of cylinders in which the combustion is stopped can be changed as appropriate with "number of cylinders−1" as a maximum value. In addition, it is not always needed to fix the cylinder in which the combustion is stopped to a predetermined cylinder. For example, the cylinder in which the combustion is stopped may be changed for each combustion cycle.

The oxygen supply process is not limited to the specific cylinder FC process described above. For example, the oxygen supply process may be a dither control in which the air-fuel ratios of the air-fuel mixtures of some cylinders of the cylinders are made leaner than the stoichiometric air-fuel ratio and the air-fuel ratio of the air-fuel mixture in the remaining cylinder is made richer than the stoichiometric air-fuel ratio. In addition, the oxygen supply process may be an all-cylinder fuel cut process of stopping the combustion of all of the cylinders, for example, the fuel cut process at the time of deceleration.

The GPF 34 is not limited to the filter supported by the three-way catalyst, and may be solely the filter. In addition, the GPF 34 is not limited to be provided the downstream of the three-way catalyst 32 in the exhaust passage 30. In addition, the three-way catalyst 32 may be replaced with an oxidation catalyst that oxidizes a component contained in the exhaust gas. In addition, it is not always needed to provide the GPF 34 as an exhaust gas control apparatus.

The control device is not limited to the control device that includes the CPU 72 and the ROM 74 and executes software processing. For example, the control device may include a dedicated hardware circuit, such as an ASIC that executes hardware processing on at least a software processed part in the embodiment described above. That is, the control device need only have any of the following configurations (a) to (c). (a) A processing device that executes all of the processes described above in response to a program, and a program storage device, such as a ROM that stores the program are provided. (b) A processing device and a program storage device that execute a part of the processes described above in response to a program, and a dedicated hardware circuit that executes the remaining process are provided. (c) A dedicated hardware circuit that executes all of the above processes is provided. Here, a plurality of software execution devices including a processing device and a program storage device or a plurality of dedicated hardware circuits may be provided.

The vehicle is not limited to a series and parallel hybrid vehicle, and may be, for example, a parallel hybrid vehicle or a series hybrid vehicle. In addition, the vehicle is not limited to a hybrid vehicle, and may be, for example, a vehicle in which a power generator of the vehicle is solely the internal combustion engine 10.

What is claimed is:

1. A control device applied to an internal combustion engine including a catalyst that cleans an exhaust gas in an exhaust passage and having a plurality of cylinders, wherein the control device is configured to execute an oxygen supply process of supplying oxygen to the exhaust passage, a deterioration reduction process of reducing a rate of deterioration of the catalyst, a process of calculating an increase amount of deterioration obtained by subtracting from a first degree of deterioration that is a degree of deterioration of the catalyst during execution of the oxygen supply process a second degree of deterioration that is a degree of deterioration of the catalyst in a case where the oxygen supply process is assumed not to be executed, a process of calculating an integrated value of the increase amount of deterioration, and a process of executing the deterioration reduction process in a case where the integrated value is equal to or larger than a predetermined first determination value.

2. The control device according to claim 1, wherein:

a relationship between engine operation information when the oxygen supply process is executed and the first degree of deterioration is predetermined; and the first degree of deterioration is calculated based on the engine operation information acquired when the oxygen supply process is executed.

3. The control device according to claim 1, wherein:

a relationship between engine operation information when the oxygen supply process is not executed and the second degree of deterioration is predetermined; and the second degree of deterioration is calculated based on engine operation information acquired when the oxygen supply process is executed.

4. The control device according to claim 1, wherein the control device is configured to execute a process of calculating a reduction amount of deterioration obtained by subtracting a third degree of deterioration that is a degree of deterioration of the catalyst during execution of the deterioration reduction process from a fourth degree of deterioration that is a degree of deterioration of the catalyst in a case where the deterioration reduction process is assumed not to be executed, a process of updating the integrated value by subtracting the reduction amount of deterioration from the integrated value, and a process of terminating the deterioration reduction process in a case where the integrated value updated in the process of updating is equal to or smaller than a predetermined second determination value that is set to a value smaller than the first determination value.

5. The control device according to claim 4, wherein:

a relationship between engine operation information when the deterioration reduction process is executed and the third degree of deterioration is predetermined; and the third degree of deterioration is calculated based on the engine operation information acquired when the deterioration reduction process is executed.

6. The control device according to claim 4, wherein:

a relationship between engine operation information when the deterioration reduction process is not executed and the fourth degree of deterioration is predetermined; and the fourth degree of deterioration is calculated based on engine operation information acquired when the deterioration reduction process is executed.

* * * * *